US011602483B2

(12) United States Patent
Almgren

(10) Patent No.: US 11,602,483 B2
(45) Date of Patent: Mar. 14, 2023

(54) APPARATUS FOR STIMULATION

(71) Applicant: Rikard Almgren, Örebro (SE)

(72) Inventor: Rikard Almgren, Örebro (SE)

( * ) Notice: Subject to any disclaimer, the term of this patent is extended or adjusted under 35 U.S.C. 154(b) by 746 days.

(21) Appl. No.: 16/491,283

(22) PCT Filed: Mar. 7, 2018

(86) PCT No.: PCT/SE2018/050218
§ 371 (c)(1),
(2) Date: Sep. 5, 2019

(87) PCT Pub. No.: WO2018/164631
PCT Pub. Date: Sep. 13, 2018

(65) Prior Publication Data

US 2020/0030182 A1 Jan. 30, 2020

(30) Foreign Application Priority Data

Mar. 8, 2017 (SE) ..... 1730063-3
Mar. 28, 2017 (SE) ..... 1730086-4

(51) Int. Cl.
*A61H 19/00* (2006.01)
*A61H 23/02* (2006.01)

(52) U.S. Cl.
CPC ..... *A61H 19/44* (2013.01); *A61H 23/0263* (2013.01); *A61H 2201/0192* (2013.01); *A61H 2201/0207* (2013.01); *A61H 2201/0221* (2013.01); *A61H 2201/0228* (2013.01); *A61H 2201/0242* (2013.01); *A61H 2201/169* (2013.01); *A61H 2201/1654* (2013.01); *A61H 2201/5097* (2013.01)

(58) Field of Classification Search
CPC ..... A61H 19/00; A61H 19/40; A61H 19/44; A61H 19/50; A61H 23/0263
See application file for complete search history.

(56) References Cited

U.S. PATENT DOCUMENTS

2014/0228628 A1 8/2014 De Alva
2016/0074276 A1* 3/2016 Scheuring ..... A61H 19/34 600/38

FOREIGN PATENT DOCUMENTS

WO 2017/054072 A1 4/2017

OTHER PUBLICATIONS

International Search Report, dated Jun. 4, 2018, corresponding to International Application No. PCT/SE2018/050218.

(Continued)

*Primary Examiner* — John P Lacyk
(74) *Attorney, Agent, or Firm* — Ladas & Parry LLP; Malcolm J. MacDonald

(57) ABSTRACT

An apparatus for stimulation of erogenous body zones, such as a dildo and/or vibrator, having a through heating repeatedly moldable polymeric core (2) which becomes plastically moldable upon heating to a temperature above about 40° C., and which is dimensionally stable at normal body temperature and below. In result of its moldability, the apparatus can eliminate the need for separate articles for different kinds of stimulation. A tensile and elastic skin (3) encloses the polymeric core (2). The skin smoothens the shape of the apparatus and reduces the need for precision when reshaping the polymeric core.

21 Claims, 4 Drawing Sheets

(56) References Cited

OTHER PUBLICATIONS

"Amazing Polymorph Plastic Easy to Mould Thermoplastic Endless Uses" [video sequence from Youtube]. [retrieved Oct. 10, 2017] Retrieved from the web: <URL:https: //www.youtube.com/watch?v=lhVuc6RNyaw> as well as the comment from "MrzPicatu" 3 years ago.

* cited by examiner

Fig. 3
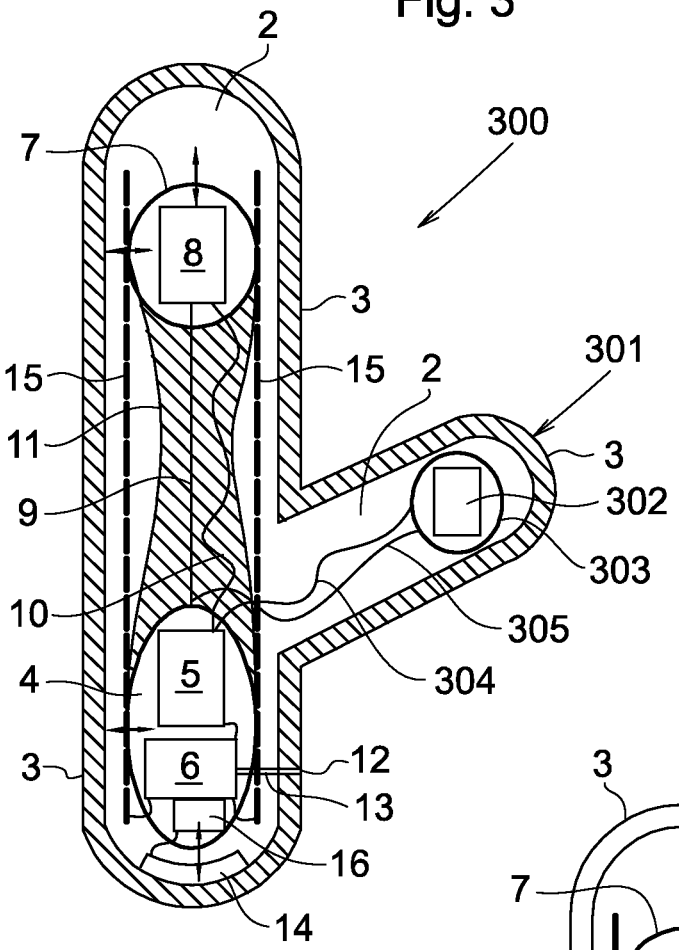
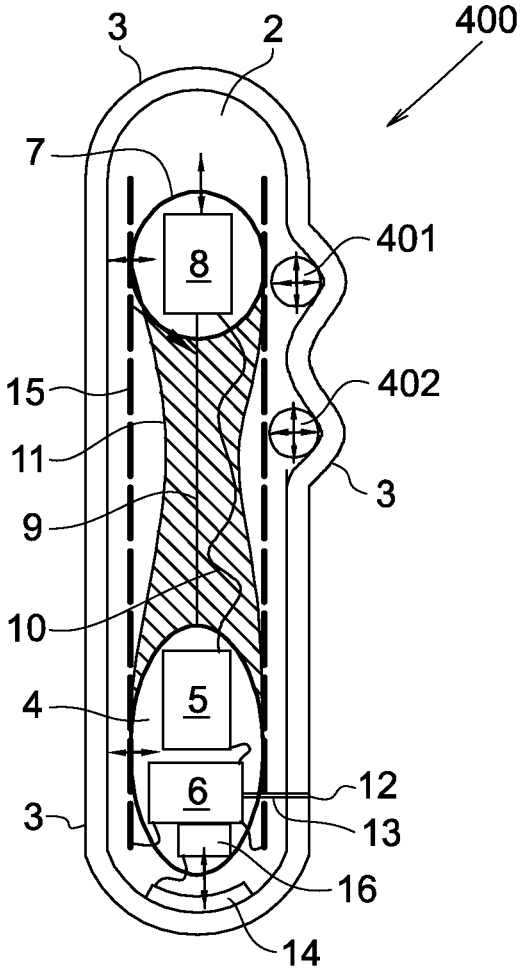
Fig. 4

APPARATUS FOR STIMULATION

TECHNICAL FIELD OF THE INVENTION

The present invention relates to an apparatus for stimulation of erogenous body zones, such as a dildo or a vibrator.

BACKGROUND AND PRIOR ART

It is commonly known that an active sex life can lead to improved general well-being among men and women. The present invention addresses those men and women who acknowledge this aspect of their life.

More precisely, the invention relates to an apparatus arranged for stimulation of erogenous body zones, both those which are exposed on the outside as well as such erogenous body zones that are concealed within an opening of the body. Known products for this purpose are hampered by the fact that the shape they are given in manufacturing only admits a few combinations of use and stimulating acts, determined by choice of material and manufacturing process. The kind of material typically used in this type of apparatus, such as dildos and vibrators, includes plastic, metal and occasionally burnt minerals (glass, porcelain, clay), or wood. Limitations in use due to the given shape necessitates the existence of dozens of versions from the same manufacturer, dedicated for different uses.

SUMMARY OF THE INVENTION

An object for the present invention is to remove the above-mentioned problem associated with a use that is limited by a fixed shape which is permanently set in manufacturing of a dildo or vibrator.

According to the invention the problem is solved through the provision of a dildo and/or a vibrator which can be reshaped by the user and adjusted to various uses and degrees/combinations of sexual stimulation.

More precisely, the invention briefly discloses an apparatus for stimulation of erogenous body zones, such as a dildo and/or a vibrator, comprising a through heating repeatedly mouldable polymeric core which becomes plastically mouldable upon heating, and which is dimensionally stable at a temperature that is lower than the temperature at which plasticity occurs.

More precisely, the apparatus comprises a polymeric core which can be repeatedly reshaped upon heating, which becomes plastically mouldable when heated to a temperature of about 40° C. (typically about 38-42° C.) or higher, and which is dimensionally stable at body temperature (about 37° C.) and below.

In one embodiment of the invention the polymeric core comprises a thermoplastic.

A polymorph plastic polymer, such as PCL (polycaprolactone), is specifically preferred.

The apparatus preferably comprises a tensile, elastic skin made of plastic, rubber, or a mixture thereof, the skin enclosing the polymeric core.

The skin may have a thickness of at least about 2 mm, preferably in the range of about 2-5 mm.

In one embodiment, the skin is in one of its ends sealed by insertion of a plug of skin material or skin compatible material.

A body may be arranged in tandem with the polymeric core preferably inside the skin. This body is not thermoformable at temperatures below the melting point of the polymeric core.

In order to set the polymeric core in a heat transfer relation for thermoforming, heating can be applied via an electrically conductive heating element or by externally applied heat.

An electric heating element may thus be arranged in a heat transfer relation, internally or externally, to the polymeric core. The heating element can be realized as a flexible resistance heating wire or a resistance heating band which is integrated or embedded in the polymeric core. In one embodiment of the invention, the heating element is a flexible, electric current conducting carbon fibre band.

The heating element may be electrically connected to a rechargeable accumulator which is encapsulated or housed in the polymeric core.

In an alternative embodiment, the heating element is instead electrically connected to a connection terminal for supply of operating power from external current source to heat the heating element.

The heating element may be an IR light source.

In one embodiment of the invention, a rise in temperature is thus caused by infrared heat radiation at a frequency which has influence on the temperature of the polymeric plastic from the outside. In another embodiment of the invention the rise in temperature is caused by hot liquid, such as water, at a temperature of at least about 40° C., arranged in heat transfer relation to the polymeric core and thus influencing the temperature of the polymer plastic.

In yet an embodiment, the invention is applied to a vibrator comprising a vibrator body which is arranged at least partially to be set in a vibrating condition through activation of an electric motor, powered by an accumulator to act on the vibrator body.

At least one vibration generating electric motor can be housed in a dimensionally stable first motor capsule, located in the polymeric core.

At least one additional electric motor can be housed in a dimensionally stable second motor capsule which is connected to the first motor capsule, at an alterable relative distance, by means of a flexible anchoring link and a current conductor.

The above-mentioned accumulator is advantageously housed in one of the first or second motor capsules.

Control means for activation and control of the vibrator is advantageously arranged inside the skin.

A receiver for wireless transmitting of control signals to the vibrator motor(s) and/or to the heating element may additionally be located inside the skin.

Discrete bodies, which are arranged floating freely in the polymeric core, can optionally be moved to an advanced position near the surface of the polymeric core, or be pressed deeper into the polymeric core, when the polymeric core is in the plasticised state.

Further features, details and advantages provided by the invention will be disclosed below in the following detailed description of embodiments, as additionally defined in the appended set of claims.

BRIEF DESCRIPTION OF THE DRAWINGS

Embodiments of the invention will be more closely disclosed below with reference made to the accompanying, schematic drawings, wherein FIG. 3 is a corresponding sectional view showing an apparatus according to a third embodiment of the invention, FIG. 4 is a corresponding sectional view showing an apparatus according to a fourth embodiment of the invention.

DETAILED DESCRIPTION OF PREFERRED EMBODIMENTS

Initially it shall be emphasized, that even though the invention is described below in respect of a battery-operated dildo/vibrator, the central aspect of the invention can nevertheless be utilized in a motor free dildo/vibrator, or in different variants of the illustrated apparatus, with or without activation of a vibrator function.

Figure 1:
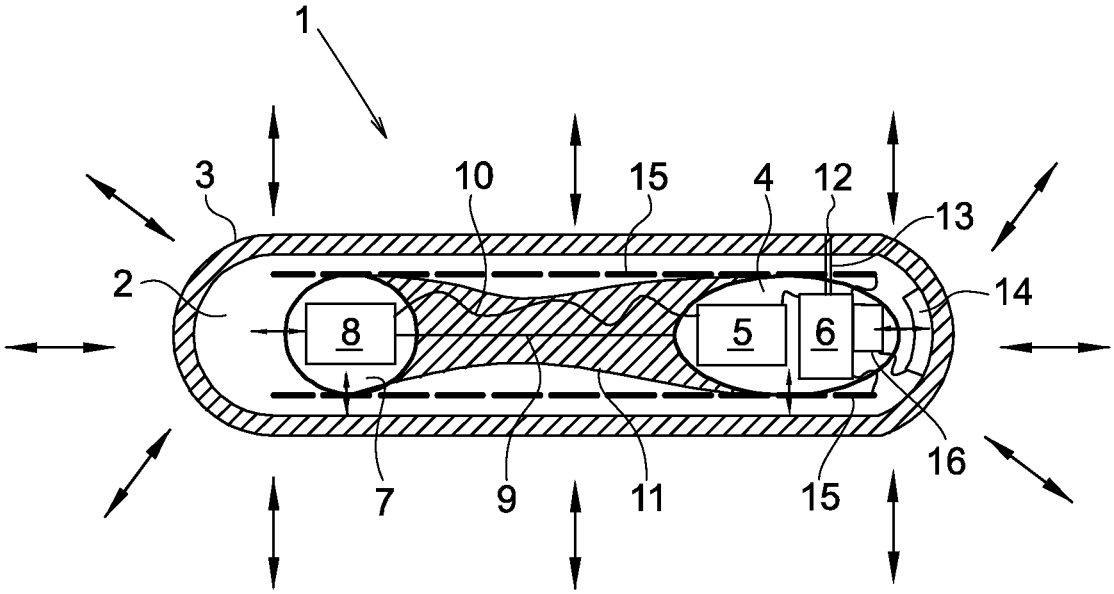
FIG. 1 is a sectional view showing an apparatus according to a first embodiment of the invention.

In FIG. 1, an apparatus according to the invention is illustrated in the form of a dildo with vibrator function. This dildo comprises a vibrator body 1 having a core 2 which is completely, or at least to a major part thereof, enclosed by a surrounding skin 3. A first motor capsule 4 housing an electric motor 5 is embedded in the core, as is an electric accumulator or battery 6. An apparatus according to FIG. 1 thus belongs to a group of battery operated massage/vibrator articles which are adapted, e.g., to be brought along for use in various environments and situations as desired.

A second motor capsule 7, housing an additional electric motor 8, is connected to the first motor capsule 4 via a flexible but non-tensile link 9 and electrically coupled to the accumulator 6 via a current conductor 10. The link 9 permits decreasing the relative distance between the motor capsules 4 and 7, while simultaneously ensuring that a maximum relative distance between the motor capsules never exceeds the length of the current conductor 10.

Said link 9 and the conductive wire 10 may be embedded inside a protective body or casing 11 that occupies a cavity between the motor capsules 4 and 7 in the core 2. The body or casing 11 is preferably made in a tensile and elastic material such as plastic, rubber, or mixtures thereof. Advantageously, the body or casing 11 can be made in silicone, e.g.

The motor capsule 4, as well as the motor capsule 7 where applicable, are dimensionally stable which here means that they have the ability to withstand pressure without being deformed, such as the body weight applied by a user in use of the vibrator. They can also withstand increased temperature in connection with reshaping of the vibrator in ways that will be more closely explained below.

The motor capsule 4 (as well as the motor capsule 7 if appropriate) can be made in wood, plastic or metal, and shaped as a shell or as a solid body which closely encloses the embedded components.

A generator respectively is operatively connected to each motor and can be driven by the motor to generate vibration in the vibrator body. Said generator can, in a way known per se, include a balance wheel with an eccentrically located point of gravity coupled to the motor axis.

Charging of the accumulator 6 is accomplished via a terminal 12, arranged on the exterior of the vibrator for connection of the accumulator to an external charging unit. This connection terminal 12 can be realized as a USB contact or as a socket for a coaxial contact, connecting the accumulator to the external charging unit via a current conductor 13. The charging unit, not shown in the figure, typically comprises a transformer and a rectifier (AC/DC converter) as is known per se.

An operating means with control means 14 for operation and control of the vibrator is arranged inside the skin 3, at a position in the vibrator body that facilitates access from the outside. The control means 14 may include a circuit breaker for switching the vibrator on and off, and pressure sensitive contacts for stepwise or continuous increase/decrease of rotational speed in the motors 5 and 8.

The skin 3 is made of a water and oil resistant, tensile and elastic material. The skin 3 is preferably made in plastic, rubber, or a mixture thereof. Naturally, the skin 3 contains no toxic or allergenic components. A suitable material is silicone. The skin 3 may be moulded about the core 2.

The skin 3 has a thickness which is determined, on one hand, with respect to its ability to withstand wear, and on the other hand determined with respect to its ability to transmit vibrations to the user without undue cushioning. The skin 3 typically has a thickness of at least 2 mm, preferably in the range of 2-5 mm. The properties of the skin are of course also depending on hardness of the material. For the subject purpose, a material hardness in the range of 25-55 Shore A (ASTM D2240 type A) may advantageously be selected.

The present invention discloses a mouldable core 2 made in thermoformable polymer material which is dimensionally stable at normal body temperature and below, while transforming into a plastically mouldable state at a comparatively low plasticising temperature. Here, plasticising temperature refers to a temperature at which the material becomes mouldable and can be given a deformation that remains permanent after cooling. In this connection, dimensionally stable means that the core 2, in the following also named the polymeric core 2, can be flexible and springy/elastic at normal body temperature (about 37° C.) and below, but will at this temperature, however, typically not undergo permanent deformation under a stress or tension which is lower than its breaking strength. Conceivable materials in the polymeric core 21 are thermoplastic elastomers or thermoplastics, for example.

The polymeric core 2 preferably comprises a by heating repeatedly mouldable thermoplastic which becomes plastically mouldable at temperatures above about 40° C. A so called polymorph plastic polymer, and a polyester plastic especially, is particularly preferred.

A particularly advantageous material for design of the polymeric core 2 is PCL, which is an abbreviation for polycaprolactone. PCL is a polymorph plastic polymer which transforms into a plasticised state at temperatures above about 42° C., having a melting point of about 60° C., while being elastic at normal body temperature.

A heating element 15 is arranged for heating the polymeric core 2 to plasticising temperature. The heating element is, in other words, arranged in a heat transfer relation to the polymeric core 2. The heating element 15 may be embedded and integrated in the polymeric core 2.

In one embodiment, the heating element 15 is realized in the form of a flexible carbon fibre band embedded in the polymeric core 2. Carbon fibre bands are electrically conductive and form resistors when connected to an electric source. This property is used in various applications, such as in electrically heated blankets, chair seats or in clothing. The temperature in the surface of the carbon fibre band can be determined by adapting the surface area of the carbon fibre band to the current supplied. In the present invention, this measure is used to permit a surface temperature of about 50-55° C. at maximum. The carbon fibre band can be provided in the form of one or more, substantially in parallel running lengths, or in the form of a loop or coil. The carbon fibre band may additionally be attached to the motor capsules 4 and 7 in order to counteract dislocation during reshaping of the polymeric core.

The heating element 15 may alternatively be realized in the form of an electric resistance heating wire with a flexible and heat insulating coating which limits the outside temperature of the heating element to about 50-55° C. An insulated heating wire may in this way be formed as a loop or coil embedded in the polymeric core 2.

However, the heating element 15 may also be completely omitted in favour of an externally applied radiant heating from an electrically powered heat bed supplying, e.g., infrared radiation in a medium- or long-wave frequency range for heating of the thermoplastic/polymer. The heating element 15 may also be completely omitted in favour of an externally applied heat from warm or hot liquid which affects the temperature in the thermoplastic/polymer by surrounding the apparatus, partially or completely, with the liquid.

Heating the heating element 15 can be accomplished using current supply from the accumulator 6. The heating element may alternatively be connected to a connection terminal for supply of operating current from external current source to heat the heating element. Said connection terminal can be the same terminal 12 which is intended for transfer of charging current to the accumulator, provided that the terminal 12 is arranged with a switch for shifting between charging of the accumulator and heating of the heating element.

Electronic components and functionalities for control of motors, accumulators and heating elements can be assembled on an electronic circuit board 16 in association with the accumulator 6. The circuit board 16 may, if appropriate, also include a receiver of control signals generated by an outside control unit and transferred by wireless transmission, such as blue tooth transmission, e.g., from a remote-control unit, a cell phone or from a computer via a computer application.

In this connection it shall also be noted that the heating element 15 may be disposed in a peripheral region of the polymeric core 2, in order this way to reduce the heating time needed for a shallow modification of the shape as compared to the heating time required for a deep-reaching change to the shape of the apparatus. The technical effect provided in this embodiment can be used, e.g., to bring forward some harder and dimensionally stable bodies or balls which are embedded and flowing free in an outer or peripheral region of the polymeric core, this way giving the apparatus a knobby or dimpled outside.

The polymeric core can be moulded around the embedded components upon manufacturing. The skin can be moulded around the polymeric core in a successive manufacturing step. Depending on choice of materials, the skin and polymeric core can be combined in a co-casting process.

The skin may alternatively be afterwards mounted and sealed in a final manufacturing step. For example, the polymeric core may be inserted through the open end of a pre-manufactured skin in the shape of a hose or sock, which is afterwards sealed in its open end.

Figure 7:
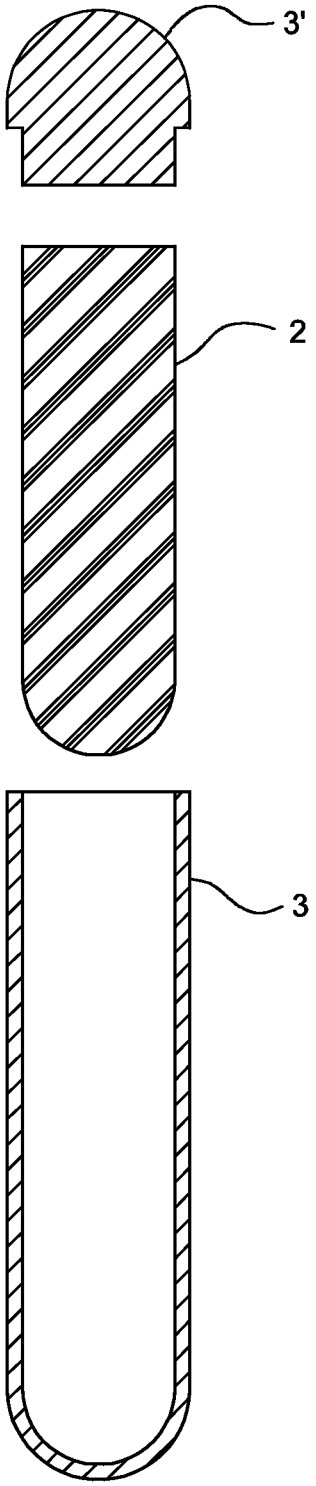
FIG. 7 shows one embodiment of the invention in an exploded sectional view.

Sealing may be accomplished by melting or gluing and may additionally include the insertion and fixation of a sealing plug 3' (see FIG. 7) made of skin material or skin compatible material.

The skin may be undersized to exert a contractive pressure about the polymeric core in order to sit tightly about the core regardless of shape. Adherence between the skin and the polymeric core can be ensured in various other ways, such as by gluing, crimpling, or by melting at the interface between the skin and the polymeric core.

As one advantageous embodiment, the invention is realized in a repeatedly re-mouldable polymeric core comprising a polymorph plastic polymer enclosed inside a flexible silicone skin, optionally in combination with one or more vibration motors.

The moulding properties of a polymorph plastic polymer such as PCL at temperatures between about 42° and 60° C. can be compared to modelling clay. In the appended drawings, the plasticity of the dildo and/or vibrator is indicated by the introduced bidirectional arrows which schematically illustrate available directions of local expansion and contraction of the core in its plasticised state.

When cooled to below about 42° C., the material rapidly hardens into solid form having an elongation and breaking strength comparable to semi-flexible plastics (somewhat similar to a rigid sole of a shoe or the plastic in a plastic tub, e.g.). An outer skin, e.g. of silicone, has a higher elongation than has the thermoplastic polymer of the core. The skin can thus accommodate a reshaping without breakage whereby the dildo/vibrator, as an integer unit, can adopt any shape of the polymeric core.

Heating to plasticising temperature can be effectuated inside the apparatus, preferably by supply of electric current to a carbon fibre band embedded in the polymeric core. By proper dimensioning of the heat emitting surface the carbon fibre band can be adjusted to emit sufficiently high surface temperature, such as about 50-55° C. Heating can be accomplished using rechargeable batteries or by connection to the electric mains via a transformer.

Heating may alternatively be effectuated by means of an outside heating source, such as an IR light source, which is connected to a battery or to the electric mains. A box, forming a heat bed, can be provided for the purpose. Heating can also be effectuated by flushing or lowering the apparatus in warm or hot liquid, such as water, having a temperature of at least about 40° C.

The skin that encloses the apparatus also protects the user from the higher temperatures occurring during reshaping of the apparatus. From a user point of view, a noticeable aspect is that the apparatus assumes a comfortable surface temperature making it ready for use immediately after reshaping.

It serves to be mentioned that a polymorph plastic polymer uses, so to speak, stored energy which is released each time it is heated, whereby the material does not get exhausted (provided that it is trapped in a body and no part of the material is lost). If breakage should eventually occur, this material will easily melt together upon heating.

In the vibrator embodiment, motors and electronic connections can be of known specifications and may include, e.g., one or more electric motors with different and/or variable frequency and pulse rate.

As a result of the unique composition and combination of materials in the dildo/vibrator, the need for various kinds of apparatuses is reduced or omitted since the user himself/herself can shape and adapt the apparatus for a specific use, starting with a basic, but changeable shape.

Figure 2:
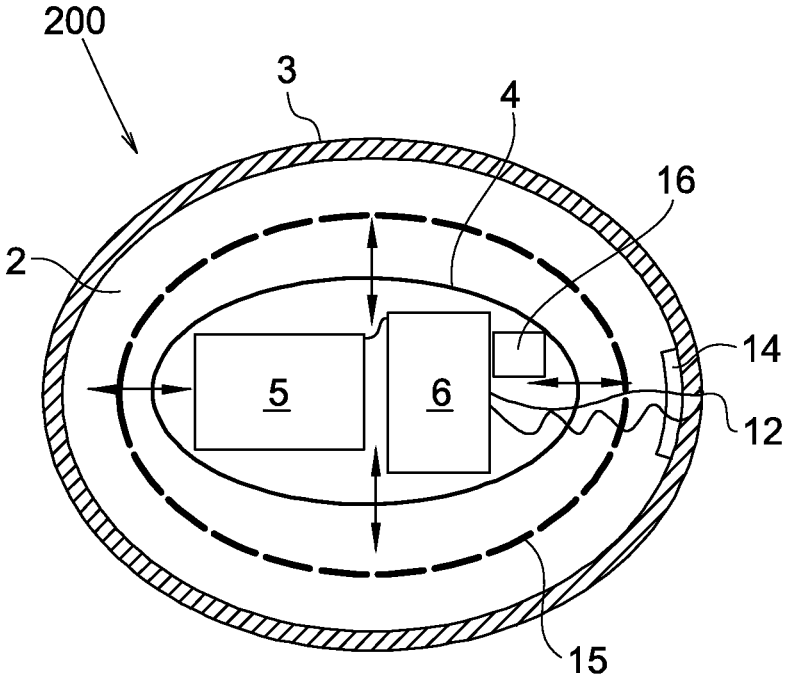
FIG. 2 is a corresponding sectional view showing an apparatus according to a second embodiment of the invention.

As examples of embodiments in alternative to the elongate basic shape that is shown in FIG. 1, a vibrator body 200 of elliptic or egg-shaped design, but otherwise of corresponding structure, is shown in FIG. 2. Since the rest of the components in the vibrator of FIG. 2 can be identical with the corresponding components in the apparatus of FIG. 1, accordingly they have received the same reference numbers.

Yet another alternative embodiment 300 is shown in FIG. 3. In this case, the basic shape of FIG. 1 is additionally equipped with a protruding appendix 301. Yet an additional motor 302 with vibrator function is installed in a third motor capsule 303, disposed in the appendix 301. A current conductor 304 and an anchoring link 305 connects the third motor capsule 303 to the first motor capsule 4, in substantially the same way and with corresponding functionality as previously explained with reference to the apparatus of FIG. 1. The rest of the components in the embodiment of FIG. 3 can be identical with the corresponding components in the embodiment of FIG. 1, accordingly they have received the same reference numbers.

A fourth embodiment of the apparatus is disclosed in FIG. 4. The apparatus of FIG. 4 comprises a vibrator body 400 substantially in correspondence with the vibrator body 1 of FIG. 1. A difference is however that the vibrator body 400 includes a set of discrete, solid or non-solid bodies 401, 402 etc., embedded in the polymeric core 2. When heating the polymeric core to a plasticised state, as previously explained, the bodies 401, 402 may optionally be displaced towards the periphery and moved into a more advanced position in order to provide the apparatus a knobby or dimpled exterior. Or in the reverse, the bodies can be pressed deeper into the polymeric core in order to provide the vibrator body 400 a smoother exterior. These bodies 401, 402 which are, so to speak, floating freely in the polymeric core, can also be moved to other locations in the dildo/vibrator. The rest of the components in the embodiment of FIG. 4 can be identical with the corresponding components in the embodiment of FIG. 1, accordingly they have received the same reference numbers.

As previously mentioned, the benefits provided by the present apparatus can also advantageously be utilized in alternative embodiments which are void of the integrated vibrator function. Furthermore, in alternative embodiments, the heat which is required to reach plasticising temperature in the polymeric core can be supplied from an external heat source. In such case, no integrated heating element whatsoever will be required.

Figure 5:
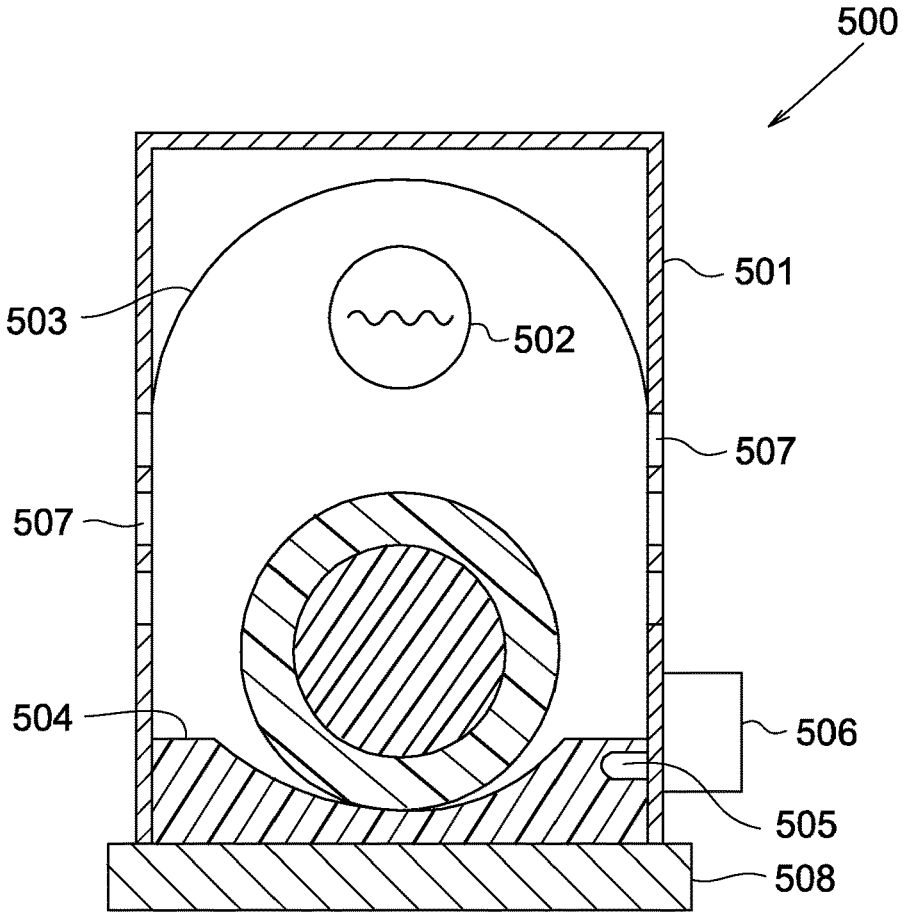
FIG. 5 shows a housing for heating the apparatus in a sectional view.

With reference made to FIG. 5, a heating station 500 shown in sectional view accommodates an apparatus of the invention which is lacking internal heating capacity. The heating station 500 comprises a housing 501 wherein an electric heating source 502, preferably an IR light source 502, is arranged below a reflector 503. At the bottom of the housing there is arranged a bed 504 on which the apparatus is placed while being irradiated by the heating source. The bed 504 is preferably made in a material having a thermal conductivity similar to that of the polymeric core 2. In such case, a temperature sensor 505 which is arranged to detect the temperature in the bed 504 can also provide a close indication on when the polymeric core of the apparatus has reached plasticising temperature. The temperature sensor 505 can be connected to a control means 506 arranged on the exterior of the housing 501. Signalling between the temperature sensor 505 and the control means 506 can be wireless or done by a fixed wire. The control means 506 may include a thermostat that cuts the current to the heating source 502 when the bed 504 has reached a pre-set temperature. The housing 501 can be made in metal to reflect heat from its inside walls towards the apparatus. The housing walls can include openings 507 for air circulation and distribution of the radiant heat from the heating source. The housing 501 may include one open side for insertion and placing the apparatus on the bed 504. Alternatively, the housing may be detachably placed on a base plate 508.

Figure 6:
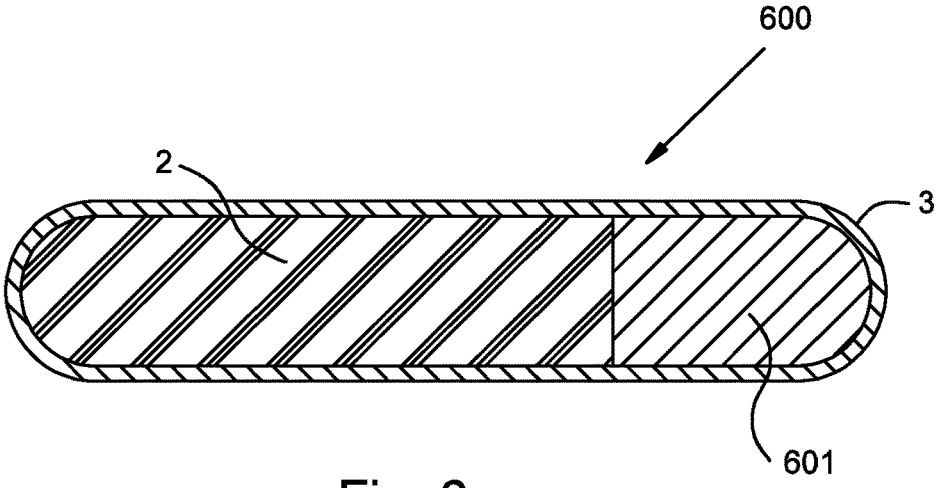
FIG. 6 shows the apparatus in yet another user-friendly embodiment in a sectional view.

The embodiment 600 of FIG. 6 comprises a body 601 arranged in tandem with the polymeric core 2 inside the skin 3. The body 601 provides a handle which is dimensionally stable in any temperature at which the polymeric core is plastically mouldable. In fact, the body 601 can be made of a plastic material which is not thermoformable whatsoever, or at least not thermoformable below the melting point of the polymer used in the polymeric core 2. The body 601 can be made of any material that is compatible with the polymer in the core and the rubber or synthetic rubber in the skin, such as plastic, a cellulose based polymer, or wood, e.g.

Accordingly, starting from a basic shape, the present invention offers to the user a possibility of shaping an apparatus such as a dildo and/or a vibrator into various angular, elongated and thin or short and compact shapes, with a blunt or pointy tip, or applying to the apparatus a swelling in a central portion or towards an end of the apparatus, or giving the apparatus the spherical shape of a ball or a flattened shape, optionally with protruding appendices or bulges, etc., by the means of heating, kneading and applying uncomplicated manipulation by hand.

As mentioned above, the apparatus of the present invention may even include discrete bodies in various geometrical shapes (such as circular, triangular, square etc.) made in a material which is dimensionally stable in spite of the generated heat and which can be moved about inside the apparatus.

It serves eventually to be mentioned, that only the innovative mind of the user sets the limits for what can be achieved through the almost unlimited mouldability that is offered by the dildo and/or vibrator as disclosed hereinabove.

The invention claimed is:

1. An apparatus for stimulation of erogenous body zones in a form of a dildo, comprising:

a through heating repeatedly mouldable polymeric core; and a tensile, elastic skin enclosing the polymeric core;

wherein the skin is manufactured from plastic or rubber, or a mixture of plastic and rubber;

wherein the polymeric core becomes plastically mouldable upon heating, and is dimensionally stable at a temperature which is lower than the temperature at which plasticity occurs.

2. The apparatus of claim 1, wherein the polymeric core comprises a polymorphic plastic polymer.

3. The apparatus of claim 1, wherein the skin has a thickness of at least about 2 mm.

4. The apparatus of claim 1, wherein the skin is in one end sealed by insertion of a plug of skin material or skin compatible material.

5. The apparatus of claim 1, comprising a body arranged in tandem with the polymeric core, wherein the body is not thermoformable at temperatures below the melting point of the polymeric core.

6. The apparatus of claim 1, further comprising an electric heating element arranged in heat transfer relation, internally or externally, to the polymeric core.

7. The apparatus of claim 6, wherein the heating element is a flexible resistance heating wire or resistance heating band integrated in the polymeric core.

8. The apparatus of claim 7, wherein the heating element is an electric current conducting, flexible carbon fibre band.

9. The apparatus of claim 6, wherein the heating element is electrically connected to a rechargeable accumulator, encapsulated in the polymeric core.

10. The apparatus of claim 6, wherein the heating element is electrically connected to a connection terminal for supply of operating power from external current source to heat the heating element.

11. The apparatus of claim 6, wherein the heating element is an IR light source.

12. The apparatus of claim 1, comprising a warm or hot liquid having a temperature of at least 40° C., arranged in heat transfer relation to the polymeric core.

13. The apparatus of claim 1, further comprising an. electric motor, powered by an accumulator, wherein activation of the electric motor causes the apparatus to be at least partially set in a vibratingstate.

14. The apparatus of claim 13, wherein the electric motor is housed in a dimensionally stable first motor capsule in the polymeric core.

15. The apparatus of claim 14, further comprising at least one additional electric motor housed in a dimensionally stable second motor capsule which is connected to the first motor capsule, at an alterable relative distance, by means of a flexible anchoring link and a current conductor.

16. The apparatus of claim 15, wherein said accumulator is housed in first motor capsule or the second motor capsules.

17. The apparatus of claim 13, wherein control means for activation and control of the vibrator is arranged inside of the skin.

18. The apparatus of claim 17, further comprising a receiver for wireless transmitting of control signals to at least one of the electric motor and a heating element.

19. The apparatus of claim 1, further comprising discrete bodies which are arranged freely floating in the polymeric core, said bodies are movable to a position near the surface of the polymeric core, or deeper into the polymeric core, when the polymeric core is in the plastcized state.

20. The apparatus of claim 1, wherein the polymorphic plastic polymer is polycaprolactone.

21. The apparatus of claim 1, wherein the skin has a thickness in a range of about 2-5 mm.

* * * * *